US006381787B1

(12) United States Patent
Rogone et al.

(10) Patent No.: US 6,381,787 B1
(45) Date of Patent: May 7, 2002

(54) INFANT POSITIONING DEVICE

(75) Inventors: Mary S. Rogone; Philip N. Rogone, both of Victorville, CA (US)

(73) Assignee: Small Beginnings, Inc., Victorville, CA (US)

( * ) Notice: Subject to any disclaimer, the term of this patent is extended or adjusted under 35 U.S.C. 154(b) by 0 days.

(21) Appl. No.: 09/500,736

(22) Filed: Feb. 9, 2000

(51) Int. Cl.[7] ..... A47C 21/08; A61G 9/06

(52) U.S. Cl. ..... 5/655; 5/420; 5/425

(58) Field of Search ..... 5/655, 417, 419, 5/420, 424, 425, 427, 482, 485

(56) References Cited

U.S. PATENT DOCUMENTS

| | | | | | |
|---|---|---|---|---|---|
| 3,924,282 | A | * | 12/1975 | Bond | 5/485 X |
| 4,383,713 | A | * | 5/1983 | Roston | 5/655 X |
| 4,566,449 | A | | 1/1986 | Smith | 128/133 |
| 4,607,402 | A | * | 8/1986 | Pollard | 5/425 |
| 4,754,509 | A | * | 7/1988 | Pollard | 5/425 |
| 4,873,734 | A | * | 10/1989 | Pollard | 5/425 |
| 5,035,013 | A | * | 7/1991 | Bloom | 5/420 |
| 5,088,139 | A | * | 2/1992 | Bloom | 5/420 |
| 5,165,130 | A | * | 11/1992 | Wendling | 5/655 |
| 5,193,238 | A | * | 3/1993 | Clute | 5/655 |
| 5,216,772 | A | * | 6/1993 | Clute | 5/655 |
| 5,261,133 | A | | 11/1993 | Wilkerson | 5/655 |
| 5,272,780 | A | * | 12/1993 | Clute | 5/655 |
| 5,279,237 | A | * | 1/1994 | Alivizatos | 5/655 X |
| D343,756 | S | * | 2/1994 | Sher | 5/655 X |
| 5,347,669 | A | * | 9/1994 | Neviaser et al. | 5/655 |
| 5,351,348 | A | * | 10/1994 | Beger | 5/655 X |
| 5,357,642 | A | * | 10/1994 | Clute | 5/655 |
| 5,367,730 | A | * | 11/1994 | Sher | 5/655 |
| D353,494 | S | * | 12/1994 | Beger | 5/655 X |
| 5,371,909 | A | | 12/1994 | McCarty | 5/655 |
| 5,455,973 | A | * | 10/1995 | Brumfield et al. | 5/424 |
| 5,499,418 | A | * | 3/1996 | Tan et al. | 5/655 |
| 5,581,832 | A | * | 12/1996 | Bridley | 5/655 |
| D389,359 | S | * | 1/1998 | Nowak | 5/655 X |
| 5,826,287 | A | * | 10/1998 | Tandrup | 5/655 |
| 5,916,089 | A | * | 6/1999 | Ive | 5/655 |
| 5,937,461 | A | * | 8/1999 | Dombrowski et al. | 5/655 |
| D415,919 | S | | 11/1999 | Porter | D6/596 |
| D416,159 | S | | 11/1999 | Porter | D6/596 |
| 6,049,929 | A | * | 4/2000 | Rawson | 5/655 |
| 6,054,926 | A | * | 4/2000 | Deleo | 5/655 X |
| 6,097,294 | A | * | 8/2000 | Hilton | 5/655 X |

* cited by examiner

*Primary Examiner*—Robert G. Santos
(74) *Attorney, Agent, or Firm*—Skjerven Morrill MacPherson LLP; Theodore P. Lopez

(57) ABSTRACT

An infant positioning device which provides the ability to move an infant, a preterm infant, and/or a newborn between and including a supine, prone, or side-lying position, with little or no tactile stimulation of the infant caused by human touch.

18 Claims, 5 Drawing Sheets

INFANT POSITIONING DEVICE

BACKGROUND OF THE INVENTION

1. Field of the Invention

The present invention relates generally to devices and methods for supporting infants and, in particular, to devices and methods for positioning infants which avoids undesired tactile stimulation of the infant.

2. Description of Related Art

The sense of touch in a human being is highly developed in utero. Therefore, even the very immature preterm neonate has an acute tactile sensitivity. Tactile stimulation (i.e. human touch) of a neonate can both arouse and soothe. In most cases, preterm neonates thrive from tactile stimulation. However, in some instances, tactile stimulation of a neonate, especially an ill preterm neonate, may result in significant physiological consequences. For example, a physiologically stable preterm neonate, when subjected to human touch, may be benefited with increased activity, a faster regaining of birth weight, less crying, and better socialization with parents and caregivers. However, in a physiologically unstable neonate, the benefits of touch may be outweighed by detrimental consequences, which may include blood pressure changes, alterations in cerebral blood flow, hypoxia as well as other stress behaviors. Premature neonates who exhibit such symptoms when touched are usually referred to as "negative touch" or minimum stimulation patients.

In some cases, excessive tactile stimulation, which is continuously repeated, may cause the neonate to develop a touch aversion—an association of human touch with pain or extreme discomfort. Preterm neonates that have developed an aversion to touch typically cry uncontrollably, squirm away, flail arms and legs, and recoil when touched. To avoid these consequences, preterm neonates that exhibit symptoms of touch aversion or are negative touch should receive care that includes tactile interventions, such as minimal handling and body containment.

One particular aspect in the care of preterm neonates that generally requires lots of touching and handling is that of positioning. The benefit of adequate and supportive body positioning for preterm and full term neonates is well known. For example, proper positioning of the preterm neonate has been shown in some studies to greatly reduce the long-term affects of prematurity. Moreover, proper positioning increases feelings of security, promotes quieting and self-control, enhances psychological stability, promotes energy conservation, reduces psychological and behavioral stress, and enables stress to be better endured. Also, the preterm neonate should be provided with a variety of positions to prevent the negative consequences of, for example, joint stretching and/or to promote and facilitate the development of muscle tone. These positions may generally range between and include a prone, a supine, and a side-lying position. It has also been shown that preterm neonates thrive when positioned to achieve full body containment, known as "nesting."

Most neonate body positioning is accomplished in a make-shift manner that usually requires touching of the neonate. Unfortunately, for preterm neonates who suffer from symptoms related to negative touch or touch aversion, make-shift manners for providing positioning intervention may create a high degree of tactile stimulation caused by human touch. The excessive handling may counter any benefit derived from the positioning intervention.

For these reasons, what is needed is an infant positioning device which provides adequate support for an infant, including a preterm infant. The device should also provide a caregiver an ability for moving an infant between and including a supine, prone, or side-lying position, with little or no tactile stimulation for the infant caused by direct human touch.

SUMMARY OF THE INVENTION

In the present invention an infant positioning device provides support to an infant. The present invention further provides the caregiver the ability to move the infant between and including a supine, a prone, or a side-lying position, with minimal or no tactile stimulation of the infant caused by direct human touch.

In one aspect of the present invention a device is provided for supporting and positioning a neonate. The device includes a substantially conformable member and a plurality of support members. Each support member is moveable from a first position to a second position to facilitate the positioning of the neonate placed on the conformable member.

In another aspect of the present invention, a positioning device is provided for positioning an infant. The device includes a substantially conforming member. Coupled to the conformable member are at least two support members, which define a torso area on a portion of the conformable member. Each of the support members is moveable from a first position to a second position. In response to the movement of at least one of the support members, the infant is repositionable from a first posture to a second posture.

In yet another aspect of the present invention, a method for repositioning an infant is provided. The method includes positioning an infant on a positioner in a first posture; and moving a support member from a first position to a second position to reposition the infant from the first posture to a second posture.

In each aspect of the invention the positioning of the neonate is accomplished while avoiding physical contact between a caregiver and the neonate.

DETAILED DESCRIPTION

Figure 1:
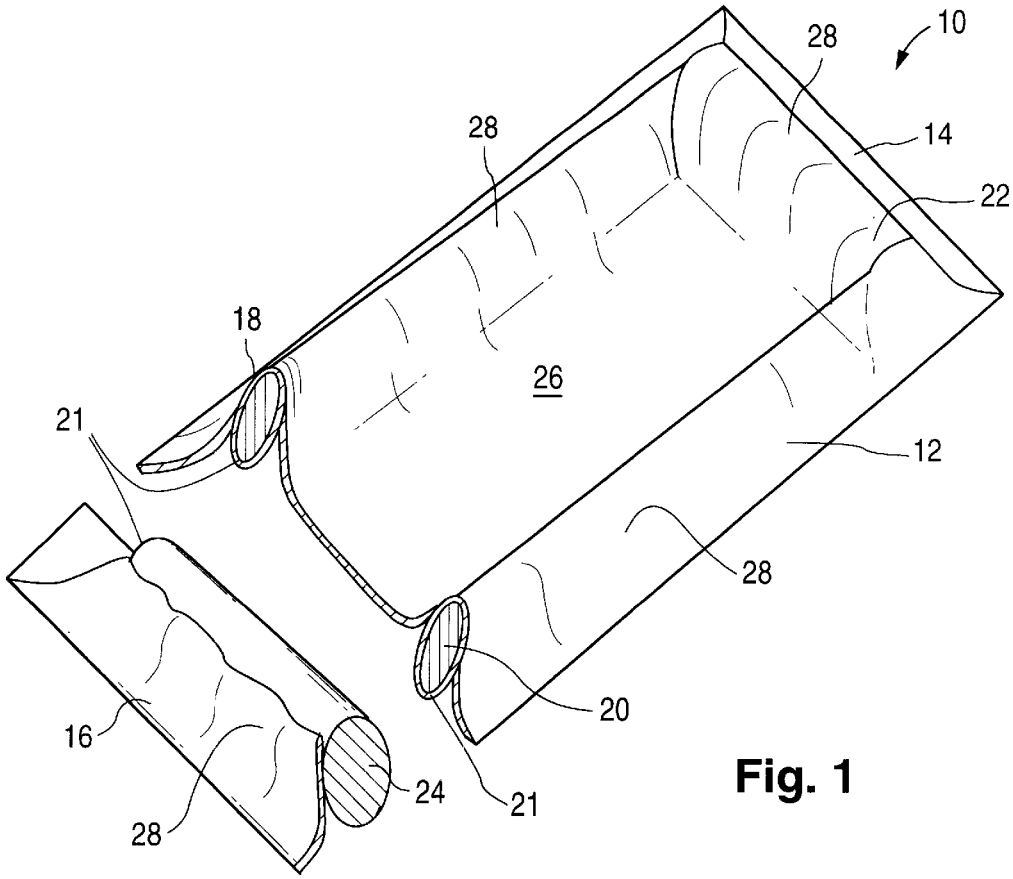
FIG. 1 is a simplified illustration of an infant positioner in accordance with the present invention.

FIG. 1, shows an infant positioning device in accordance with an embodiment of the present invention. In this embodiment, infant positioner 10 includes a conformable support member 12, having a head end 14 and a foot end 16. Coupled to infant positioner 10 are lateral support members 18 and 20, transverse support member 22, located at head end 14, and transverse foot support member 24, located at foot end 16. In one embodiment, support members 18, 20, 22, and 24 may be directly coupled to a surface of conformable member 12 using a conventional fastening means, such as with VELCRO®, by stitching, zippers or with snaps. In an alternative embodiment, support members 18, 20, 22, and 24 may be indirectly coupled to conformable member 12, using hollow sleeves 21. Hollow sleeves 21 are fastened to conformable member 12 in predetermined positions, using conventional means, such as with VELCRO®, by stitching, zippers or with snaps. Support members 18, 20, 22, and 24 may be removably inserted into sleeves 21, as described in more detail below.

As best understood with reference to FIG. 1, support members 18, 20, 22, and 24 may be arranged to form approximately a rectangle, with conformable support member 12 being placed over the support members. With conformable member 12 in position over the support members, support members 18, 20, 22, and 24 form convoluted portions 28, which define a recessed central torso area 26. Torso area 26 is sized and shaped by manually positioning support members 18, 20, 22, and 24. Preferably, the torso area is shaped for receiving the torso of an infant, including a preterm neonate. Although support members 18, 20, 22, and 24, have been shown arranged in a rectangle, any other geometric arrangement is considered to be within the scope of the present invention. For example, support members 18, 20, 22, and 24 may be positioned into a circular, a square, or a triangular arrangement.

Figure 2A:
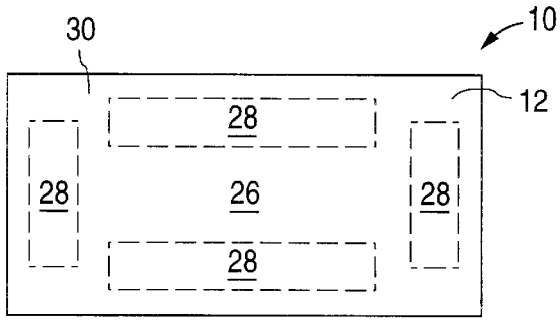
FIGS. 2A and 2B are simplified illustrations of top and bottom plan views of the positioner of FIG. 1.
Figure 2B:
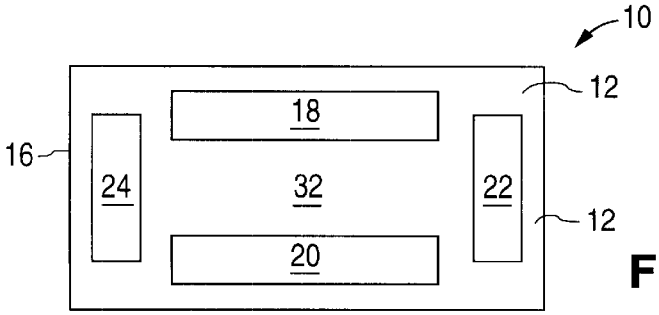

FIGS. 2A and 2B, illustrate a top and bottom view, respectively, of infant positioning device 10. FIG. 2A, shows conformable support member 12, placed over support members 18, 20, 22, and 24 (not shown), to form convoluted areas 28, which surround torso area 26. Preferably, conformable member 12 can include any substantially flexible and comfortable material that can conform to the arrangement of support members 18, 20, 22, and 24 and has a density suitable for cushioning the neonate. Conformable member 12 may include, but is not limited to a padded blanket or a thin padded mattress. Although, conformable member 12 is shown in FIG. 2A as substantially a rectangular shaped member, member 12 may include any suitable geometric shape, which can be used for the intended purpose of conformable member 12 as described herein.

FIG. 2B, shows support members 18, 20, 22, and 24 coupled to bottom surface 32 of conformable member 12. Lateral support members 18 and 20 are coupled at opposite sides of underside 32, and extend generally from head end 14 toward foot end 16 of positioner 10. Lateral members 18 and 20 restrict lateral movement of an infant placed in torso area 26 of positioner 10. Typically, lateral members 18 and 20 extend at least three-quarters of the distance of the lateral length of conformable member 12; preferably the lateral members extend at least half of the distance. In one embodiment, lateral support members 18 and 20 may have a length of between about 10 and 20 inches, preferably about 12 inches. Although, lateral support members 18 and 20 are shown in FIG. 2B as having approximately equal lengths, in an alternative embodiment, lateral members 18 and 20 may have different lengths.

Transverse member 22 is coupled to under surface 32 of conformable member 12 at head end 14. Lateral support members 18 and 20 cooperate with transverse member 22 to form torso area 26. In one embodiment, torso area 26 can be a substantially U-shaped area, framed on all sides by convoluted areas 28. Optionally, foot support member 24 is disposed opposite to transverse member 22 at the foot end 16 of conformable member 12. Foot member 24 acts to close in the U-shaped area defining torso area 26. In cooperation with the other support members, foot member 24 allows restriction of all movement of the neonate. This arrangement is generally referred to as a "nest" and provides the neonate with full body containment. Foot member 24 has been described herein as being optional; however, it should be understood that in alternative embodiments of positioner 10, each support member 18, 20, 22, and 24 is removable from conformable member 12, which makes the use of any one support member optional. For example, a caregiver may find it necessary for a given positioning intervention to use only one lateral support member in cooperation with the transverse and foot support members.

Figure 3A:
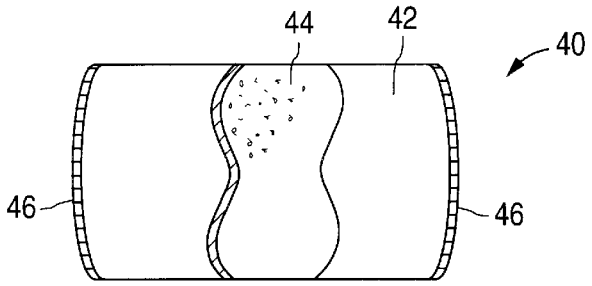
FIGS. 3A and 3B are simplified illustrations of an embodiment of a support member in accordance with the principles of the present invention.
Figure 3B:
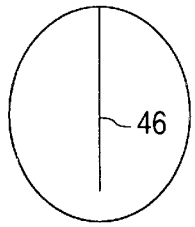

Lateral support members 18, 20, transverse member 22, and foot support member 24 are each typically made of a resilient material that can be conformed to a shape that provides support to the infant placed in torso area 26. Support members 18, 20, 22, and 24 may be constructed in a manner similar to what are commonly referred to as bead bags or else pillows. In one embodiment, illustrated in FIG. 3A, each support member may be made from a collapsible bag 42 that contains a filler material 44. In this embodiment, collapsible bag 42 may contain polystyrene beads 44, or optionally, bag 42 may contain filler materials 44, such as a polysilicon gel, feathers, air, liquid, resilient foam and flaxseed. The outer material of bag 42 may be made of any resilient and conformable material that is capable of holding contents within the bag, such as the above-described filler materials. Examples of bag materials include vinyl, plastic, tightly woven cloth, fleece, and the like. As shown in FIG. 3B, end 46 of bag 40 may be sealed in a conventional manner that allows for securely holding the contents. For example, a plastic bag 42 may be heat sealed or glued, whereas a cloth bag 42 may be stitched.

In the embodiment illustrated in FIG. 1, support members 18, 20, 22, and 24 are cylindrical in shape. However, the length, width, diameter, and overall shape of the support members may be varied to provide any desired arrangement. For example, support member 40 (FIG. 3A) may be constructed in lengths and diameters that allow for adequate support of infants of variable sizes and shapes. In most cases, the support members can be at least half as long as the length of the torso portion of the neonate. Since the support members are removable and replaceable, it may be appreciated by those of skill in the art that as the neonate grows, differently sized and shaped support members may be used to accommodate such growth.

Figure 4A:
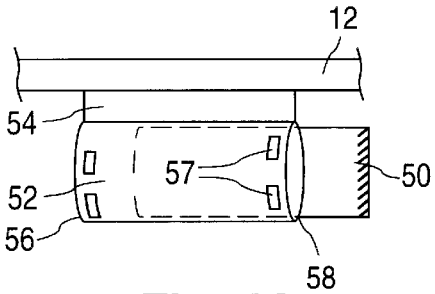
FIGS. 4A–4E are simplified illustrations of embodiments of the support member described in FIGS. 3A and 3B.
Figure 4B:
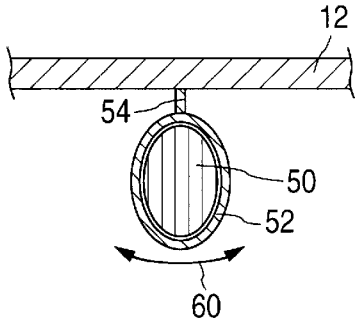

Each support member 18, 20, 22, and 24 may be directly or indirectly coupled to conformable member 12. In one embodiment, support members 18, 20, 22, and 24 are coupled to conformable member 12 in a manner that allows the support members to be movable. Preferably, the movement includes pivoting or swinging support members 18, 20, 22, and 24 from the coupling point. In one embodiment, shown in FIGS. 4A and 4B, an exemplary support member 50 is shown coupled to conformable member 12 indirectly through hollow sleeve 52. Hollow sleeve 52 may be coupled to member 12 using any conventional fastening means 54, which may include sewing sleeve 52 to member 12. Alternatively, sleeve 52 may be coupled to member 12 using, for example, a VELCRO® fastener, a tongue and groove device, a zipper, buttons, snaps, or other similar fastening means. Support member 50 is removably insertable into hollow sleeve 52. Optionally, sleeve 52 may be closeable at ends 56 and 58 using conventional closing means 57, such as VELCRO® fasteners, a zipper, buttons, snaps, or other similar means, which facilitate holding support member 50 in sleeve 52.

Figure 4C:
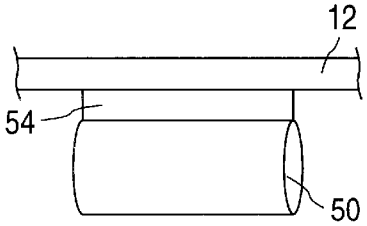
Figure 4D:
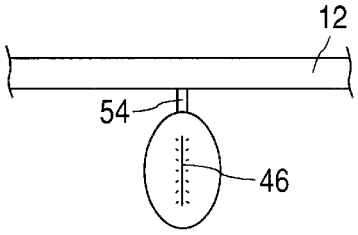
Figure 4E:
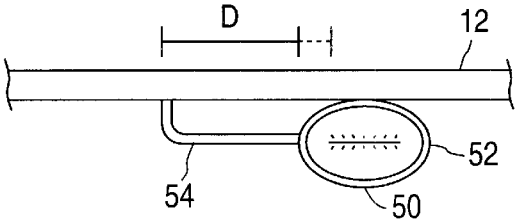

Support member 50 is moveable between a first and a second position. Typically, the motion is a pivoting or swinging movement in the direction generally indicated by arrow 60 in FIG. 4B. Optionally, fastening means 54 may also include an extended strip of material, as shown in FIG. 4E, which allows support member 50 not only to swing or pivot, but to be moved a distance D relative to the coupling point of fastening means 54. In an alternative embodiment, as illustrated in FIGS. 4C and 4D, support member 50 may be coupled directly to member 12 using any one of the above-described fastening means 54 or their equivalent.

Figure 5A:
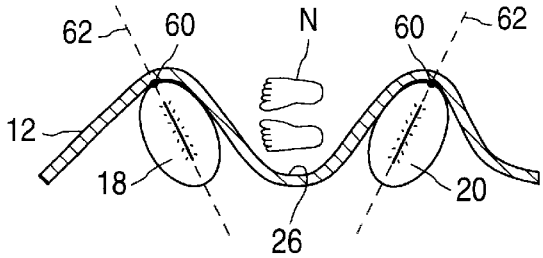
FIGS. 5A–5D are simplified illustrations of a method for positioning an infant in accordance with the principles of the present invention.
Figure 5B:
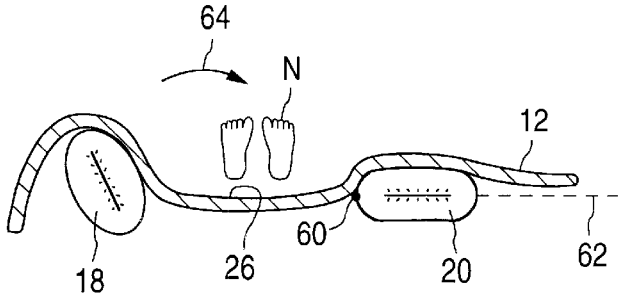
Figure 5C:
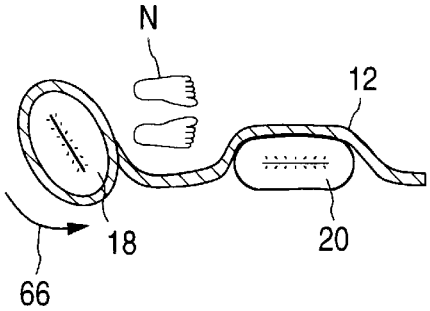

FIGS. 5A–5C illustrate an example, with no intention to limit the invention thereby, an embodiment of the operation of positioner 10. In this embodiment, positioner 10 may be manipulated (i.e., rotated, pivoted, moved, etc.) so as to reposition a neonate N placed on positioner 10. Preferably, the infant is repositioned without requiring the caregiver to directly touch the infant.

FIGS. 5A–5C show a rear end view of positioner 10 with a neonate N positioned in torso area 26. Additional support members are not shown for ease of illustration. In this example, neonate N is in a side-lying position as indicated by the direction of the neonate's feet. To support neonate N, support members 18 and 20 are snugged up against neonate N, and may optionally be turned in under the infant. Once neonate N is placed in torso area 26, support members 18 and 20 may be manipulated from below conformable member 12, such that there is no direct touching necessary between the neonate and the caregiver.

To reposition neonate N, torso area 26 may be expanded by pivoting, swinging, or otherwise moving one or both of support members 18 and 20. For example, as shown in FIG. 5B, support member 20 is pivoted or rolled, such that torso area 26 is made larger, so neonate N can be rolled over in the direction indicated by arrow 64. Preferably, neonate N rolls as member 20 is being moved away, so that neonate N is supported at all times during the repositioning maneuver. In this example, the neonate is made prone. However, alternatively as indicated in FIG. 5C, neonate N may be rolled back to a side lying-position, if the caregiver so desires. In this example, to perform the maneuver of FIG. 5C, support member 18 is rolled under in the direction indicated by arrow 64, such that member 18 pushes under the neonate's body, thereby forcing the neonate to continue to roll.

Figure 5D:
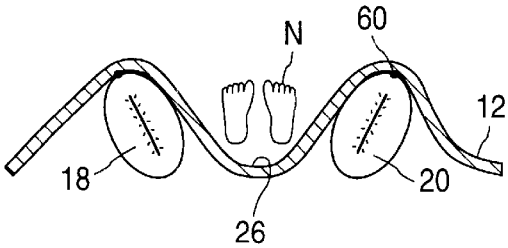

As shown in FIG. 5D, members 18 and 20 may be moved back so as to be snugged against neonate N once neonate N is in the desired position. Those who are skilled in the art will appreciate that during the movement of support members 18 and 20, the neonate N, whether in a prone, supine, or side-lying position, or moving therebetween, is adequately supported and protected by the support members. Moreover, because in each repositioning maneuver described above, support members 18 and 20 are moved or manipulated from below conformable surface 12, one of skill in the art should also appreciate that there is no need for the caregiver to have to directly touch or tactily stimulate neonate N.

Given the above example, it will also be appreciated that the length and diameter of the support members can be changed and still cooperate with each other to perform the positioning and repositioning function. Accordingly, different support members of different lengths and different diameters can be used together as the neonate grows. Also by using support members of different lengths and different diameters, different neonates can use the same positioning device. By allowing for a variation of lengths and diameters, the care giver is given greater latitude in performing the new positioning function which suites the personal needs of the neonate and/or the care giver.

Figure 6A:
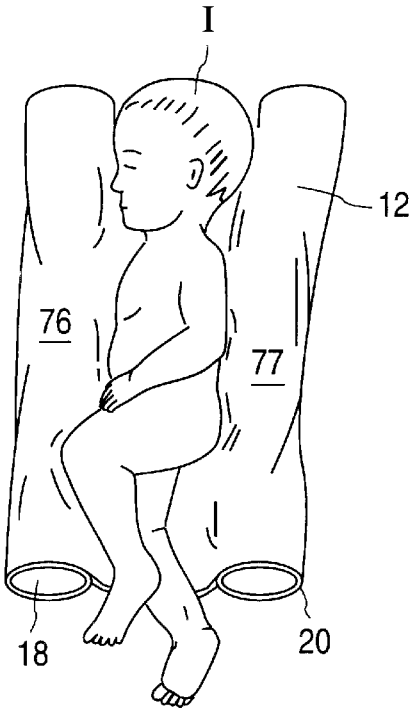
FIGS. 6A–6C are simplified illustrations of an alternative method for positioning an infant in accordance with the principles of the present invention.
Figure 6B:
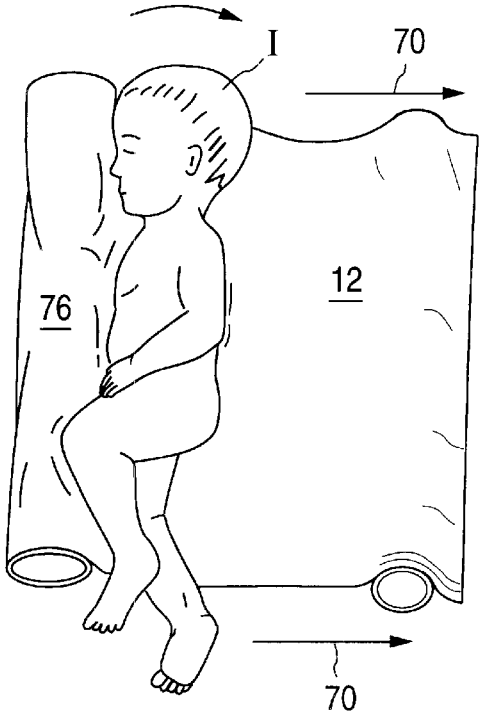
Figure 6C:
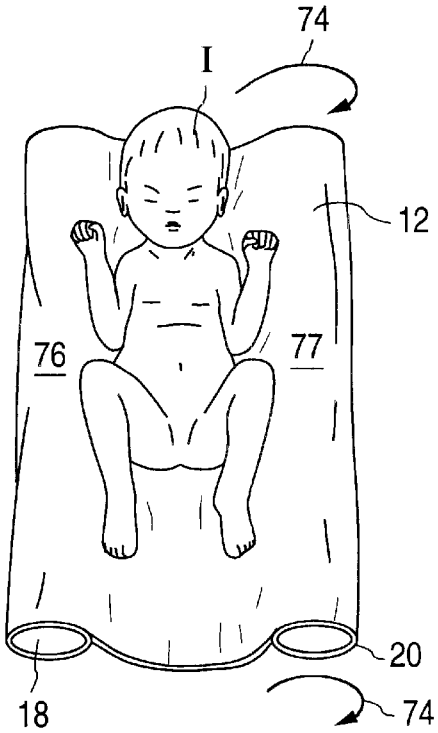

FIGS. 6A–6C illustrate a method for moving an infant I between a first posture and a second posture. As shown in FIG. 6A, conformable member 12 may be wrapped about lateral support members 18 and 20 to form convoluted areas 76 and 77, such that torso area 26 is formed therebetween. Infant I is placed on conformable member 12 in torso area 26 in either a supine, a prone, or a side-lying position or in some position in-between. Each of the lateral support members may then be positioned snugly against infant I. Once the infant I is to be moved, either lateral member 18 or 20, and in some instances both, may be unrolled in the direction shown by arrow 70, such that convolution 77 is unfurled. Infant I can then simultaneously, or when desired, roll in the direction indicated by arrow 72 from a side-lying position to a prone position or else back to a side-lying position. Once infant I has been moved, member 20 may be re-rolled as indicated by arrows 74, such that convolution 77 is reformed by member 20 and is snugly supporting infant I.

Optionally, transverse member 22, foot member 24, or both, may have been added to positioner 10 in the above embodiment. As described above, transverse member 22 and foot member 24 may be rolled in and out to provide support and facilitate positioning of neonate N.

Figure 7A:
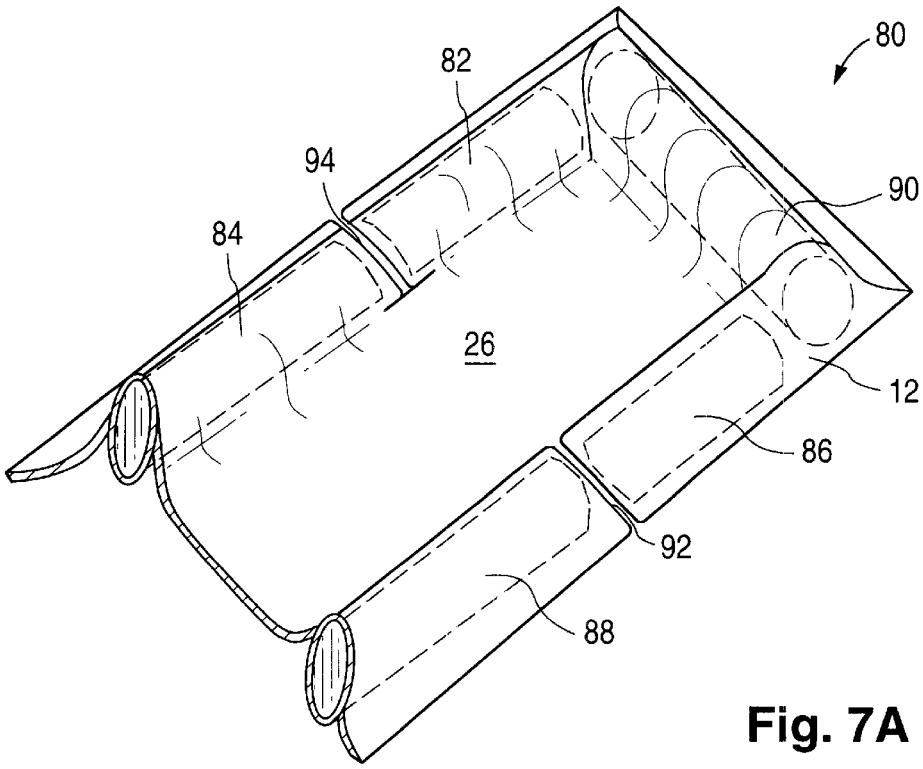
FIGS. 7A and 7B are simplified illustrations of an alternative embodiment of the positioner of FIG. 1.
Figure 7B:
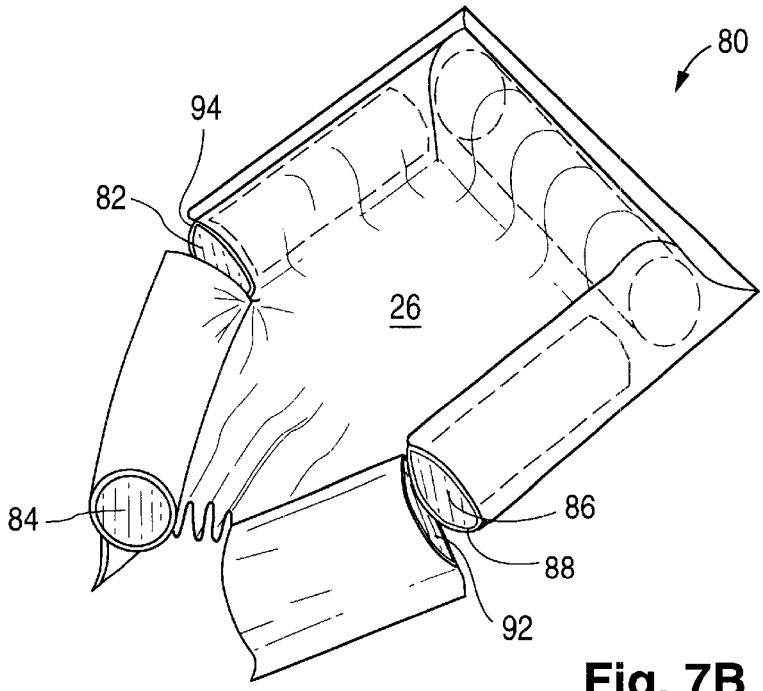

FIGS. 7A and 7B, show an alternative embodiment of the present invention. In this embodiment, positioner 80 includes multiple lateral members 82, 84, 86, and 88, where members 82 and 84 are disposed opposite members 86 and 88. Conformable member 12 may have slits 92 and 94, which are directed in away from an edge of member 12 towards torso area 26. As shown in FIG. 7B, slits 92 and 94 allow members 82, 84, 86, and 88 to be moved independently of one another either in or out from torso area 26 to provide the caregiver with additional options for positioning and supporting infant I. In one embodiment, members 84 and 88 may be pivotally attached or hinged to members 82 and 86, respectively.

Although the present invention has been described with reference to specific embodiments, these embodiments are illustrative only and are not intended to limit the invention in any manner. Modifications and variations will become apparent in light of the disclosure and the following claims. All such modifications and variations are within the scope of the invention as set forth in the claims when interpreted in accordance with the breadth to which they are legally and equitably entitled.

What is claimed is:

1. A device for supporting and positioning a neonate, the device comprising:

a conformable member;

a plurality of support members; and a fastening means including a plurality of hollow sleeves with an extended strip of material for coupling each of the hollow sleeves to a portion of the conformable member at coupling points inwardly spaced from edges of the conformable member, each hollow sleeve having an open end to insertably receive one of the plurality of support members, said fastening means allowing each support member to be moveable between a first position a first distance from said coupling point to a second position a second distance from said coupling point, said support members providing support to said neonate when said neonate is placed on said conformable member to facilitate the re-positioning of the neonate.

2. The device of claim 1, wherein the positioning of the neonate is accomplished without direct physical contact between the caregiver and the neonate.

3. The device of claim 1, wherein each of the extended strips of material is removably coupled to the conformable member.

4. The device of claim 1, wherein the conformable member comprises a material having a density sufficient for cushioning the neonate.

5. The device of claim 1, wherein the plurality of support members comprises:

a transverse support member coupled substantially transversely along a head end of the conformable member; and at least one lateral support member coupled substantially laterally adjacent to a lateral edge of the conformable member.

6. The device of claim 1, wherein the plurality of support members comprises a pair of lateral support members coupled substantially adjacent to opposing lateral edges of the conformable member.

7. The device of claim 1, wherein each of the plurality of support members comprises a sealable collapsible bag having a filler material.

8. The device of claim 7, wherein the filler material is taken from the group consisting of polystyrene beads, down feathers, resilient foam, air, liquid, flaxseed and silicon gel.

9. The device of claim 1, wherein the plurality of support members are configured to allow the position of the neonate to vary from a first posture when in said first position to a second posture when in said second position.

10. The device of claim 9, wherein the first and the second postures comprise a supine, a prone, and a side-lying position.

11. A positioning device for positioning an infant, the device comprising:

a substantially conforming member;

a fastening device; and at least two support members coupled using said fastening device to a portion of said conforming member at coupling points to define a torso area thereon, said fastening device including a plurality of hollow sleeves with an extended strip of material for coupling each of the hollow sleeves to a portion of the substantially conforming member at said coupling points inwardly spaced from edges of the conforming member, each hollow sleeve having an open end to insertably receive one of the plurality of support members, each of said support members configured to be moved from a first position where said support members are positioned a first distance from said coupling points to a second position where said support members are positioned a second distance from said coupling points, movement of at least one support member configured to cause the position of an infant to vary from a first posture to a second posture in response to the movement.

12. The device of claim 11, wherein the repositioning of the infant is accomplished while avoiding human touch between the infant and a caregiver.

13. The device of claim 11, wherein each of the extended strips of material is removably coupled to the conforming member.

14. The device of claim 11, wherein the conforming member comprises a material having a density sufficient for cushioning the infant.

15. The device of claim 11, wherein said at least two support members comprise:

a transverse support member coupled substantially transversely along a head end of the conforming member; and a lateral support member coupled substantially laterally adjacent to a lateral edge of the conforming member.

16. The device of claim 11, wherein said at least two support members comprise a pair of lateral support members coupled substantially adjacent to opposing lateral edges of the conforming member.

17. The device of claim 11, wherein each of said at least two support members comprise a sealable collapsible bag having a filler material.

18. The device of claim 17, wherein the filler material is taken from the group consisting of polystyrene beads, down feathers, resilient foam, air, liquid, flaxseed and silicon gel.

* * * * *